United States Patent [19]

Nickolay et al.

[11] Patent Number: 4,676,056

[45] Date of Patent: Jun. 30, 1987

[54] THREAD-BREAK MONITOR FOR RING-SPINNING AND RING-TWISTING MACHINES

[75] Inventors: Helmut Nickolay, Göppingen; Kurt Hack; Manfred Lattner, both of Ebersbach; Werner Meissner, Hattenhofen; Richard Schöllhammer, Göppingen, all of Fed. Rep. of Germany

[73] Assignee: Zinser Textilmaschinen GmbH, Ebersbach, Fed. Rep. of Germany

[21] Appl. No.: 853,356

[22] Filed: Apr. 17, 1986

[30] Foreign Application Priority Data

Apr. 17, 1985 [DE] Fed. Rep. of Germany ..... 3513921
May 13, 1985 [DE] Fed. Rep. of Germany ..... 3517183
Feb. 28, 1986 [DE] Fed. Rep. of Germany ..... 3606610

[51] Int. Cl.[4] ..... D01H 13/16

[52] U.S. Cl. ..... 57/81; 57/75; 57/80

[58] Field of Search ..... 57/78, 80, 81, 84, 86, 57/87, 75

[56] References Cited

U.S. PATENT DOCUMENTS

| | | | |
|---|---|---|---|
| 2,922,272 | 1/1960 | Hope | 57/78 |
| 2,930,179 | 3/1960 | Bailey | 57/75 |
| 2,930,180 | 3/1960 | Adams et al. | 57/81 |
| 3,102,378 | 9/1963 | Walker, Jr. | 57/87 X |
| 3,911,656 | 10/1975 | Vignon | 57/81 X |
| 4,023,341 | 5/1977 | Saino et al. | 57/81 |
| 4,254,613 | 3/1981 | Arita et al. | 57/81 |

*Primary Examiner*—John Petrakes
*Attorney, Agent, or Firm*—Karl F. Ross; Herbert Dubno

[57] ABSTRACT

Along the ring bank of a twisting or spinning machine is provided a shaft rotatable about an axis parallel to the ring bank and supporting holders for thread-break sensors inductively responding to the orbiting of the travelers. Since the holders are independent of the ring bank, they can be swung out of the way to allow replacement or maintenance of the ring bank.

22 Claims, 6 Drawing Figures

THREAD-BREAK MONITOR FOR RING-SPINNING AND RING-TWISTING MACHINES

FIELD OF THE INVENTION

Our present invention relates to a thread-break monitor for ring-spinning and ring-twisting machines, and more particular, to a device for detecting a thread breakage in a ring-spinning or ring-twisting machine utilizing a sensor for each ring which is capable of detecting the orbiting of the traveler.

BACKGROUND OF THE INVENTION

Thread-break monitors play an important role in thread and yarn spinning and twisting and usually are provided for each spindle or spinning or twisting station of such machines. While such thread-break monitors are provided in various configurations and utilizing a number of different principles, the invention is concerned with those which detect the movement of the traveler utilizing an inductive sensor.

It has been customary heretofore to mount such sensors on the ring back of the spinning or twisting machine, i.e. upon the member which extends along the spinning or twisting frame and on which the rings are mounted (see German Pat. No. 1,166,064).

A disadvantage of this system is that the electrical conductors between the sensors and the circuitry responsive thereto must extend along the various ring-bank sections and can interfere with cleaning of the ring bank or related parts of the machine or can be damaged by such cleaning operations.

As a result, the sensors must be removably-mounted on the ring bank and for such cleaning are removed in a time-consuming operation. Furthermore, since the positioning of the sensor is critical for accurate detection of thread breakage, replacement of the sensor requires time-consuming adjustment and setup operations.

It is possible to facilitate the removal of such sensors by providing plug connections for the various conductors or to utilize plug connectors to enable the conductors and their cabling to be removed, but this introduces the possibility that the large numbers of contents which must thus be connected may be defective, at least in some cases.

Furthermore, conventional methods of mounting the sensors on a ring bank have required modification of the structure thereof and this is costly in itself, especially since the parts of the ring bank and its holders are generally stamped out or cast so that modifications require revamping of the fabrication procedures, jigs and tools used in fabricating the ring bank.

OBJECTS OF THE INVENTION

It is, therefore, the principal object of the present invention to provide an improved thread-break monitor for ring-twisting and ring-spinning frames whereby these disadvantages are obviated.

Another object of the invention is to provide an improved thread monitor for the purposes described which does not hinder removal or cleaning of a ring-bank section of such a spinning or twisting frame.

Still another object of the invention is to provide a device for detecting a thread break in such a machine or frame which does not require major modification of the ring bank or parts thereof, which allows cleaning of the machine and replacement of the ring-bank sections as desired, and which avoids the introduction of potential defects in the conductive paths associated with the sensors.

SUMMARY OF THE INVENTION

These objects and others which will become more readily apparent hereinafter are attained, in accordance with the invention, by providing a sensor for each traveler orbiting on the respective ring at the respective spindle of a ring spinning or ring twisting machine, each sensor being mounted in a holder which is swingable about an axis of a shaft common to all of the holders of a respective ring bank or section thereof and extending along the ring bank.

According to the invention, therefore, between the sensors and the ring bank there is no direct connection so that removal of a ring-bank section or cleaning of the ring bank does not affect the sensors and especially does not require adjustment of the sensors anew. The electrical connections of the sensors and the conductor harness is not interfered with and thus electrical defects are excluded.

No less important is the advantage that the system of the invention allows equipping of existing machines with the thread-break monitors of the invention without major technical and construction costs.

According to a feature of the invention, the shaft is a tube traversed by the conductors which extend to and through the holders for the respective sensors and this tube carries the disk separators or partitions between the spinning and twisting stations. In other words, the tubular shaft may be the partition carrier previously provided in such machines so that this partition carrier, tube or rod can serve a double function, namely, to support the partition disks and to support the holders for the sensors. In any case, the sensors are mounted separately from the ring bank.

The conductors are protected within the interior of the shaft and do not serve as collecting surfaces for lint, thereby ensuring a cleaner operation of the machine.

The tubular shaft and the respective holders can have mutually fitting surfaces which allow the holders to be keyed on the shaft for angular connection therewith so that rotation of the holders with the shaft is possible. In this case the sensors can be swung into an inoperative position clearing the ring bank without great cost or structure.

The holders can also be connected to the shaft by clamping means so that rapid and simple mounting is provided.

We have found it to be advantageous to provide the tubular shaft with a longitudinal slit of a width equal to that of the conductors which are accommodated within the shaft so that these conductors can be inserted laterally or removed laterally, the slit being advantageously closed by a cover member. The longitudinal slit simplifies mounting and dismounting of a holder, sensor and the related conductor. The cover piece prevents accumulation of contaminants in the tubular shaft and thus avoids the danger of contamination of the assembly as a whole. The closure piece preferably is a synthetic resin bar.

According to another feature of the invention, two-part holders are provided, these holders comprising upper and lower parts having a separating plane which is generally horizontal in the working position of the holders and such that the parting or separating plane extends through the axis of the shaft carrying the holders. This also is a simple way of mounting the holders and facilitating replacement of them. Advantageously the holder has a tubular portion in which the sensor, e.g. a coil wound on a spool, is anchored.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
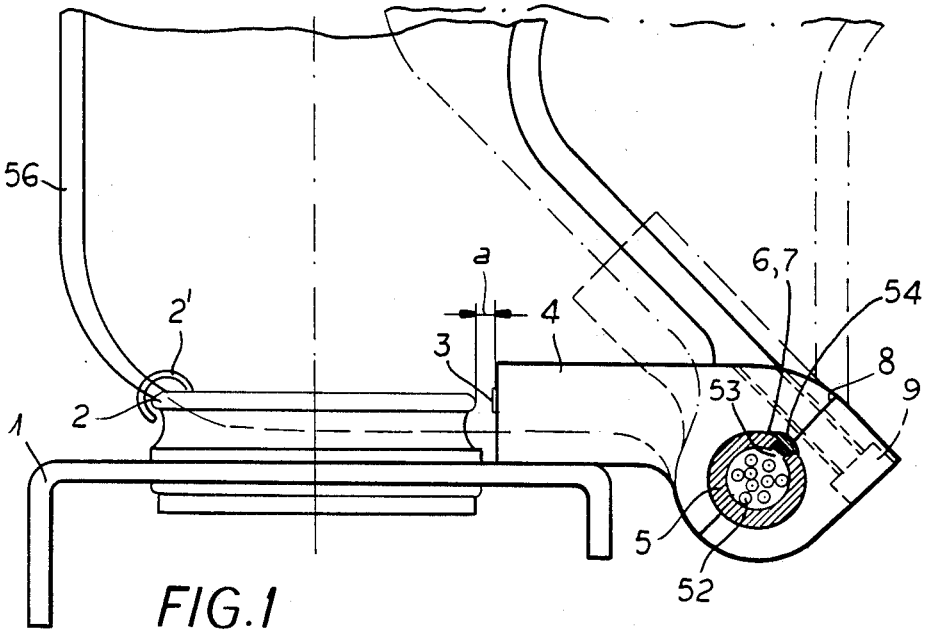
FIG. 1 is a diagrammatic elevational view of a portion of a spindle bank showing the partition between two spinning or twisting stations and the shaft carrying same which is here provided with the holders for the sensors in accordance with this invention, partly broken away.

FIG. 1 shows a ring-spinning machine having a ring bank 1 which is provided with a plurality of rings 2 surrounding respective spindles which are not visible in this Figure but which, as in conventional machines of this type, can be understood to be surrounded by the ring 2 so that a traveler 2' orbiting this ring can effect twisting or spinning of the thread or yarn.

Figure 6:
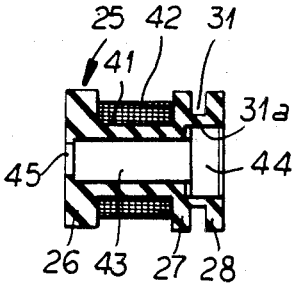
FIG. 6 is a longitudinal section through the spool and coil forming a sensor according to the invention.

To monitor thread breakage, each such ring is provided with a device which includes an inductive sensor (FIG. 6) juxtaposed with the ring and responsive to the passage of the traveler. Should the traveler come to standstill because of a thread breakage, the lack of a passage of the traveler for a certain period of time will signal this defect to permit correction of the thread breakage.

Each sensor 3 is fixed on a holder 4, in accordance with the invention, which is juxtaposed with the ring 2 and is mounted on a shaft or axle 5, preferably in the form of a tube whose axis lies parallel to the ring bank. This shaft which is fastened on the machine independently of the ring bank can also carry the separated disks or partitions 56 shown to be provided between two rings 2.

Preferably the shaft 5 is formed as a tube so that electric lines 52 can extend therethrough to the sensors 3 via the respective holders 4.

To facilitate the insertion and removal of the electrical conductors 52, for example, the tubular shaft 5 has a longitudinal slit 53, the width of which is at least equal to that of the wires so that the wires can be inserted laterally through this slit into the shaft and removed through the slit from the tube.

The slit 53 can be closed by a short cover piece 54 extending from one holder to the next. The cover pieces 54 preferably are synthetic resin pieces. The cover 54 prevents contamination of the interior of the shaft 5. The retention of the cover bar on the shaft 5 can be effected with the aid of an adhesive or by spreading the slit 53 and forcing the cover 54 into it.

Figure 2:
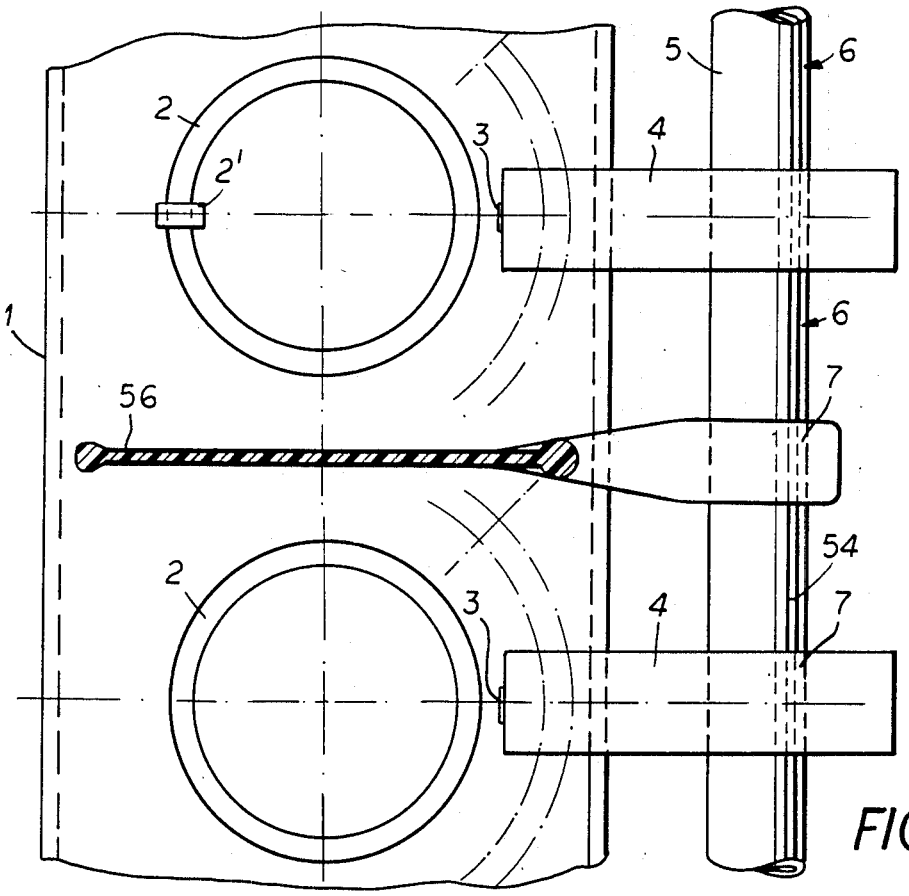
FIG. 2 is a plan view of the structure of FIG. 1 partly broken away and partly in section.

FIGS. 1 and 2 also show that the shaft 5 has a noncircular surface 6 which fits and is complementary to the surface 7 of the holder 4. This allows the holder to be mounted accurately in the proper position vis-a-vis the spinning or twisting station and also allows at least a number of such holders to be swung up simultaneously when the shaft 5 is rotated.

Each holder can be clamped on the shaft or bar 5, e.g. via a screw 9. Tightening of the screw 9 can completely close the split 8 between parts of the holder. When the holder is swung downwardly (solid line in FIG. 1), it is at the predetermined desired distance a from the ring 2.

For removal of the ring bank or a section thereof, the shaft 5 is rotated in the clockwise sense to swing the partitions 56 out of the way and simultaneously raise the holders 4 (dot-dash lines in FIG. 1) out of the path of the ring bank or ring-bank section which is thus free to be removed or repaired or maintained.

Figure 3:
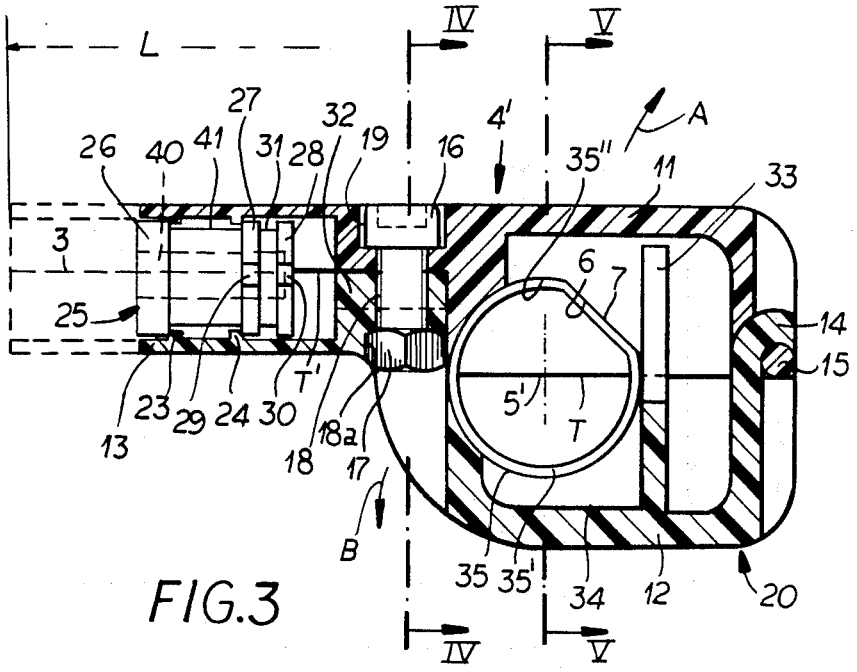
FIG. 3 is a section through one of the holders in accordance with the invention through a median vertical plane thereof.
Figure 4:
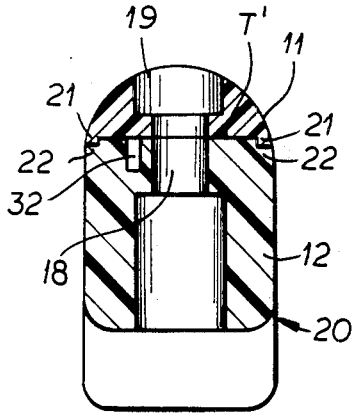
FIG. 4 is a section taken along the line IV—IV of FIG. 3.
Figure 5:
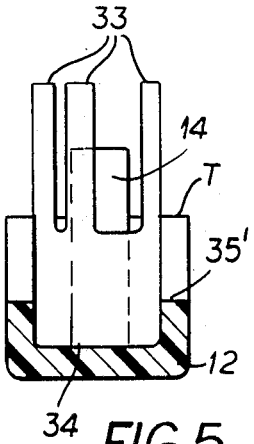
FIG. 5 is a section taken along the line V—V of FIG. 3.

FIGS. 3–5 illustrate another embodiment of the holder. The holder 4' is formed in two parts with, namely, an upper part 11 and a lower part 12. In the working position of the holder 41, the separating or parting plane T between these parts extends horizontally through the axis 5' of the tubular shaft member 35 here forming the shaft with which the holders 4' are swingable, the rotatable entrainment being ensured by the complementary interfitting surfaces 6 and 7.

Another parting plane T' extends through a snout-like tubular portion 13 of the holder 4' in which the sensor 3 is received. The upper portion 11 is engageable in and can snap into or otherwise lock into the lower portion 12.

Within the tubular portion 13 and the shaft-engaging portion 20 of the holder 4', appropriate locking means can be provided and advantageously it has been found that such locking means can include a hook-like projection 14 on the lower part 12 which can engage over a hasp-like portion or element 15 of the upper part 11 on one side of the shaft 35 while on the opposite side of the shaft 35, a bolt and a nut 16, 17, respectively, connect the two parts 11 and 12 together. This has been found to facilitate mounting and removal of the holder 41 on the shaft or tube 35.

The upper part 11 can have a countersunk opening 19 to receive the head of the bolt 16 while the lower part 12 can have a throughgoing bore 18 aligned with the countersunk recess 19 and traversed by the shank of the bolt. The nut 17 can be received in a seat 18*a* to prevent it from turning when the bolt 16 is tightened. This bolt connection 16, 17, the recess 19, the bore 18 and the seat 18*a* can be located at the end of the tubular portion 13 proximal to the shaft 35 and at the junction of this tubular portion with the shaft attachment portion 20.

A bore 35', 35" can be defined by the two parts 11 and 12 to snugly engage the member 35 when the two parts are assembled in the manner described.

FIG. 5 also shows that the opening 35' lies above the bottom of the channel-shaped lower part 12.

The parting plane T' of the tubular portion 13 (FIG. 4) traverses a pair of ribs 21 forming lateral guides on upper part 11 engageable in the complementary grooves 22 of the lower part 12, so that the two parts are arrested with respect to one another transversely to the separating direction which is represented by the arrows A and B in FIG. 3.

From FIG. 3 moreover, it will be apparent that the tubular portion 13 is provided with transversely extending repeating ribs 23 and 24 formed on the interior of the tubular portion and serving to properly position the sensor 3 by lying against inner flanks of a pair of annular flanges 26 and 27 of a spool 25 carrying a coil.

The spool 25 carries the coil 42 in the region 41 (FIG. 6) between flanges 26 and 27, another flange 28 being provided in spaced relationship to the flange 27 at the end of the spool opposite the flange 26. The sensing zone is represented at 40 in FIG. 3 and the spool receives the soft iron core 43 in a form of a cylindrical slug which is pressed against a membrane 45 at the sensing end of the spool closing the interior thereof.

At the opposite end, in a seat 31*a* in the region of a peripheral groove 31 between the flanges 27 and 28, a magnet disk 44 is press-fitted into place, abuts the slug 43, and presses it against the membrane 45. The coil 42 is constituted of very thin copper wire.

The spacing of the ribs 23 and 24 is such that, as can be seen from FIG. 3, the rib 23 engages the rear flank of flange 26 while rib 24 engages the front flank of rib 27, holding the spool in proper position within the tubular portion 13.

The rear pair of flanges 27, 28 are provided with at least one throughgoing longitudinal groove 29, 30 and the annulus groove 31 can serve for carrying thicker copper wires connected to the ends of the coil and passing through the grooves 29 and 30 and thence through a passage 32 (FIGS. 3 and 4) to the interior of the shaft 35 upon which the holder 4' is mounted. The grooves eliminate tension forces on the wire so that extremely thin wire can be used for the coils without detriment.

Projections 33 extend upwardly from the lower part 12 into the part 11 (FIG. 5) and two outer surfaces of the outer of the projections 33 simultaneously form guides for the inner wall of the upper part, thereby ensuring that the upper part 11 will reliably be positioned properly on the lower part 12.

The rear flange 28 can have further longitudinal grooves for passing wires from the sensor rearwardly if desired.

The tubular portion 13 can be formed with a maximum length L for all possible constructions or the tubular portion can be foreshortened, i.e. cut down to suit requirements, such as a comparison of the broken line showing with that of the solid line showing of FIG. 3 will reveal. The inclined keying surface 7 can be provided with a small projection which can engage in a longitudinal slit of the tube should one be provided as in the embodiment of FIGS. 1 and 2 to close this slit.

The invention is applicable to all spinning, twisting, drafting-twisting and like machines and frames having a ring bank with travelers and rings and which can be provided with a shaft-forming shaft for other purposes or exclusively to carry the holders of the invention. If a special shaft is provided for these holders, preferably it is located as shown directly behind the ring bank.

We claim:

1. A device for detecting a thread break in a ring-spinning or ring-twisting machine having a ring bank with a respective circular ring for each spindle and a traveler orbitting the spindle on the ring, said device comprising:

for each spindle, a respective sensor juxtaposed with the respective ring and responsive to the passage of the respective traveler for signaling a thread break upon an absence of detection of said traveler;

a respective holder for each sensor separate from said ring bank; and a shaft for said holders defining an axis extending parallel to said ring bank and about which said holders are swingable.

2. The device for detecting a thread break defined in claim 1 wherein said shaft defining said axis is formed as a tube accommodating electrical conductors running to said holders and the respective sensors.

3. The device for detecting a thread break defined in claim 2 wherein said tube is formed with a longitudinally extending slit of a width at least equal to a diameter of said conductors.

4. The device for detecting a thread break defined in claim 3, further comprising a cover piece closing said slit.

5. The device for detecting a thread break defined in claim 1 wherein said holders and said shaft have mutually complementary interfitting surfaces keying said holders on said shaft for joint rotation therewith.

6. The device for detecting a thread break defined in claim 1 wherein said holders are each provided with a respective clamp securing the holder on said shaft.

7. The device for detecting a thread break defined in claim 1 wherein between spindles and their respective rings, partitions are provided, said shaft carrying said partitions.

8. The device for detecting a thread break defined in claim 1 wherein said holders are each formed from two parts having a separation plane through said axis where said holders are mounted on said shaft, said separation plane extending through a tubular portion of each holder accommodating the respective sensor.

9. The device for detecting a thread break defined in claim 8 wherein said parts include an upper holder part lockably fitted into the other of said parts which is constituted as a lower holder part.

10. The device for detecting a thread break defined in claim 9 wherein one of said parts of each holder has on one side of said shaft a hook formation, the other of said parts of the respective holder has on said one side of said shaft an element engageable by said hook formation, and said parts of the respective holder are bolted together on an opposite side of said shaft.

11. The device for detecting a thread break defined in claim 10 wherein said parts of the respective holder are bolted together at an end of said tubular portion proximal to said shaft.

12. The device for detecting a thread break defined in claim 10 wherein said parts of the respective holder are formed with mating formations at said separating plane.

13. The device for detecting a thread break defined in claim 10 wherein said tubular portion is formed internally with retaining ribs transverse to a longitudinal dimension of said tubular portion for anchoring therein a coil for said sensor.

14. The device for detecting a thread break defined in claim 13 wherein said coil has a spool provided at an inner end of the coil with a pair of flanges each provided with a respective longitudinal groove adapted to pass a conductor running to said coil, at least one of said ribs lodging against one of said flanges to secure said coil in said tubular portion.

15. The device for detecting a thread break defined in claim 14 wherein said spool is hollow and receives a soft iron core in the interior thereof, said coil being wound around said spool, a magnet disk being received within said spool at one end thereof.

16. The device for detecting a thread break defined in claim 15, further comprising a membrane closing the interior of said spool at an end thereof turned toward the respective ring, said disk being located at an opposite end of said spool.

17. The device for detecting a thread break defined in claim 15 wherein said disk is received in said spool in the region of said flanges.

18. The device for detecting a thread break defined in claim 15 wherein said spool is formed with a seat for said disk, said disk being press-fitted into said seat in contact with said core.

19. The device for detecting a thread break defined in claim 14 wherein said spool has a further flange at an end thereof remote from the two first-mentioned flanges, said coil being received between said further flange and one of said first-mentioned flanges proximal thereto.

20. The device for detecting a thread break defined in claim 10 wherein said lower part of each of said holders at an end of the respective tubular portion proximal to said shaft is formed with a passage for at least one of said conductors, and with upwardly extending projections reaching into the respective upper part.

21. The device for detecting a thread break defined in claim 10, further comprising means for adjusting the length of said tubular portion in accordance with the distance of the respective ring from said shaft.

22. The device for detecting a thread break defined in claim 21 wherein said tubular portion of each holder is fabricated in the maximum length required and is foreshortenable to a lesser length for a particular application.

* * * * *